US005243961A

United States Patent [19]

Harris

[11] Patent Number: 5,243,961

[45] Date of Patent: Sep. 14, 1993

[54] PORTABLE COOKER AND SUPPORT ARRANGEMENT

[76] Inventor: Ecil J. Harris, P.O. Box 529, El Campo, Tex. 77437

[21] Appl. No.: 939,293

[22] Filed: Sep. 2, 1992

[51] Int. Cl.[5] ..... F24C 1/16

[52] U.S. Cl. ..... 126/9 R; 126/25 R; 29/DIG. 37; 29/700

[58] Field of Search ..... 126/9 R, 9 A, 9 B, 29, 126/38, 25 R; 29/DIG. 37, 700, 11

[56] References Cited

U.S. PATENT DOCUMENTS

| | | | |
|---|---|---|---|
| 1,212,162 | 1/1917 | Green | 126/9 R |
| 1,327,115 | 1/1920 | Robinson | 126/9 R |
| 1,466,343 | 8/1923 | Rouse | 126/9 R |
| 2,515,521 | 7/1950 | Loffredo | 126/9 B |
| 3,490,433 | 1/1970 | Busenbarrick | 126/9 |
| 4,548,192 | 10/1985 | Hsu | 126/9 R X |

*Primary Examiner*—Larry Jones
*Attorney, Agent, or Firm*—Jack W. Hayden

[57] ABSTRACT

A support (S) includes a back (8) with integral first and second side portions (11) and (12). Sides (6) and (7) and back (8) have integral shoulder supports which are stamped in the sides and back. There are three rows (TR), (MR) and (BR) of shoulder supports in the sides and two rows (24), (25) of shoulder supports in the back of the support (S). The three rows of stamped shoulder supports in the sides (6) and (7) and the two rows in the back (8) each preferably have one shoulder support in each row, and the stamped shoulder supports in each row are vertically aligned. The two rows of shoulder supports in the back are horizontally aligned with the rows (MR) and (BR) in the sides. A grill (G) is pivotally connected to the first and second side portions (11) and (12) to hang down adjacent the back when not in use, but can be pivoted up so that continuous edge (18) thereon can be engaged with the support shoulders in the row (TR) to hold the grill horizontally in the support S. A tray T includes an edge (26) having an inverted U to engage the support shoulders in either the row (MR) on the sides and row 24 on the back or row (BR) on the sides and (25) on the back to position it below and adjacent the grill for supporting heat generating material to the grill. The support can be readily collapsed to secure the grill and tray therein for transport.

2 Claims, 1 Drawing Sheet

PORTABLE COOKER AND SUPPORT ARRANGEMENT

STATEMENT OF THE PRIOR ART

Prior art portable grills with which applicant is familiar are somewhat complicated and not readily subject to mass production at minimum expense. Some employ full hinges as pivot means for the sides which do not limit the swinging motion of the sides as they are opened to cooking position which may render the unit less sturdy. Also the tray and grill are separate from the support which requires that both the grill and tray must be positioned in the support each time they are used. This also may increase the manufacturing cost and requires more effort to assemble for each use and disassemble after each use.

SUMMARY OF THE INVENTION

The present invention provides a portable cooking arrangement which is relatively simple and can be manufactured with a minimum of expense and more readily assembled for use and disassembled after use. The support and tray are configured so they may be formed of sheet metal. The support means for supporting a tray and a grill are integrally formed on the support which expedites the manufacturing process and reduces the time and cost of manufacture of the components.

DESCRIPTION OF THE PREFERRED EMBODIMENT

Figure 1:
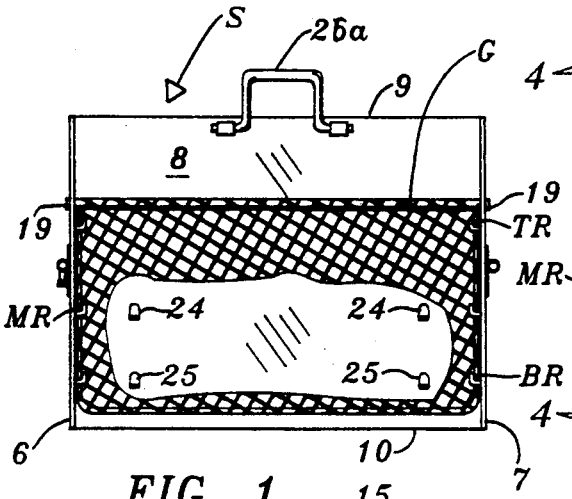
FIG. 1 is a front view showing the support with the grill partly cut away to show the support shoulders on the back aligned with the support shoulders in each side and the grill hanging down adjacent the back of the support, with the tray omitted.

Attention is first directed to FIG. 1 of the drawings which shows the support of the present invention, represented generally by the letter S, in open position with the grill G hanging down adjacent the back 8 of the support S when not in use. The tray T, shown in FIGS. 2 and 3 is omitted for purposes of clarity.

Figure 2:
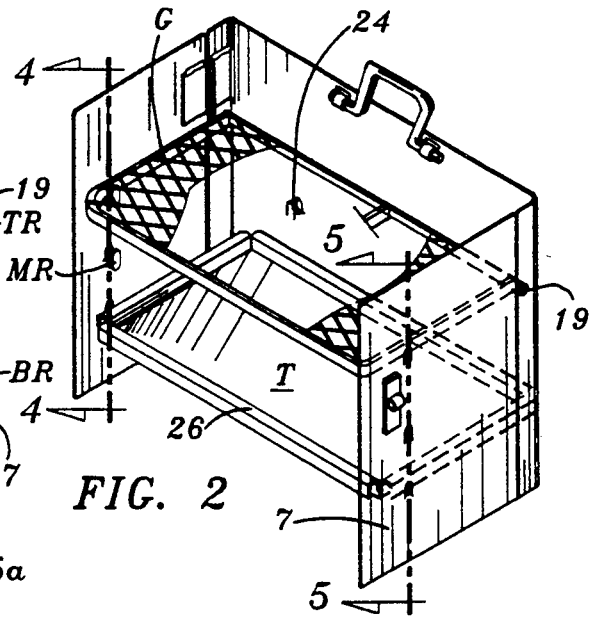
FIG. 2 is perspective view showing the grill partly cut away and the tray and grill secured with the support and supported in position in the support for cooking or barbecue.
Figure 3:
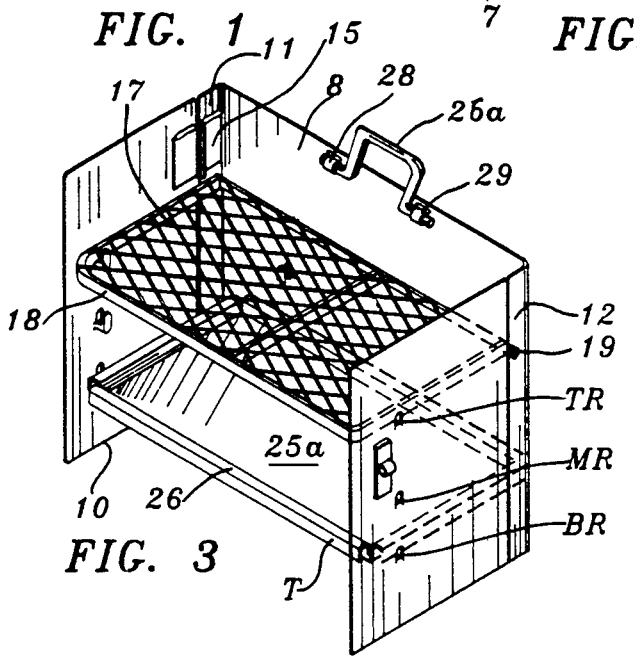
FIG. 3 is a perspective view of the present invention showing the support in open position with the grill and tray supported in position for cooking or barbecue.

FIGS. 2 and 3 show the Grill G pivoted upwardly and engaged with the top row of support shoulders, represented at TR, which support shoulders are integrally formed on the first side 6 and second side 7 of the support S and extending inwardly thereof. The details of the support shoulders are better illustrated in FIGS. 4 and 5. A middle row MR and a bottom row BR of support shoulders are each integrally formed on first and second sides 6 and 7 and rows 24,25 of support shoulders are integrally formed on the back 8 of the support S as shown in detail in other views of the drawings.

The back 8 has an upper edge 9 and a bottom edge 10 and includes integrally formed therewith first side portion 11 and second side portion 12 which projects, or extends forwardly from the back 8 as shown.

Figure 4:
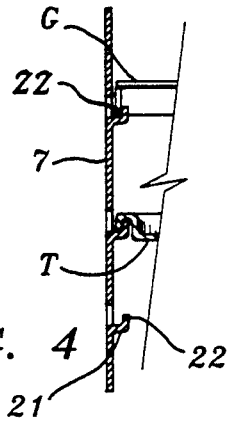
FIGS. 4 and 5 are sectional views on the line 4—4 of FIG. 2 and 5—5 of FIG. 2, respectively, illustrating the manner of engagement of the grill with the uppermost support shoulder integrally formed on the first side and the second side of the support and illustrating the manner of engagement of the inverted U edge on the tray with either of the other rows of support shoulders integrally formed formed on the back and first and second sides of the support.

The first side 6 and a second side 7 are each pivotally connected, respectively, to the first side portion 11 and second side portion 12 by any suitable means such as a hinge 15, one of which hinges 15 is shown in FIGS. 2 and 3. The other hinge 15 which connects second side portion 12 to second side 7 is arranged in a manner similar to the hinge 15 shown connecting first side portion 11 to first side 6. Preferably the hinges 15 are of the type that will limit or stop movement of the sides so as to position the first and second sides at a right angle, or vertically relative to the back 8 when they are moved or rotated to open position as shown in FIGS. 1, 2 and 4 to enable the grill to be lifted to pivot to the position shown in FIGS. 2, 3 and 4 for cooking or barbecue.

Grill G includes a screen like surface 17 formed of metal to provide large openings in a well known manner as seen in the drawings and a continuous, integral edge 18 that surrounds surface 17 and with which the continuous, integral edge of the screen is secured in any suitable well known manner by a person skilled in the art of working with sheet metal.

The grill is pivotally supported or connected adjacent its upper side end edges to the the first and second edge portions portions 11 and 12 by the first and second by members 19 which extend, respectively, from each upper side end edge of the grill and through an opening in each the first and second side portions 11 and 12 respectively a shown in the drawings.

The grill may be lifted upwardly to engage the shoulder support that is in the top row TR which shoulder support is integrally formed on each the first and second sides 6 and 7.

Sides 6 and 7 and back 8 have integral shoulder supports which are stamped in the sides and back. There are three rows TR, MR and BR of shoulder supports in the sides and two rows 24, 25 of shoulder supports in the back of the support S. The three rows of stamped shoulder supports in each sides 6 and 7 each preferably have only one shoulder support which forms each row to maintain the manufacturing cost at a minimum, but additional support shoulders may be provided if desired. The single stamped shoulder supports forming each row in the sides of the support S are vertically spaced to vertically space the rows TR, MR and BR in parallel relationship on the sides as shown. The rows 24 and 25 on the back each include two support shoulders which are spaced laterally as shown in FIG. 1 and the rows 24, 25 are vertically spaced and parallel. The shoulder supports in the rows 24, 25 are preferably vertically aligned to reduce manufacturing cost. The two rows of shoulder supports 24, 25 in the back are horizontally aligned with the rows MR and BR in the sides.

The continuous, integral grill edge 18 is engaged with the support shoulders of sides 6, 7 in the tip row TR to secure the grill horizontally in the support S. The tray T includes an edge 26 having an inverted U shape represented at 50 to engage the support shoulders in either the row MR and corresponding parallel and aligned row 24 on the back or row BR on the sides and row 25 on the back to position it below it below and adjacent the grill for supporting heat generating material adjacent the grill.

Figure 5:
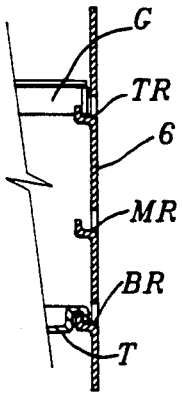
Figure 7:
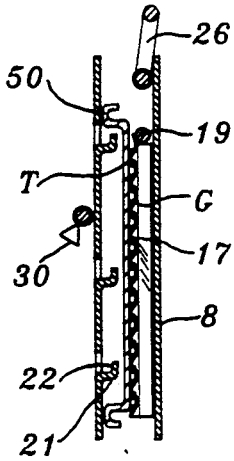
FIG. 7 is a sectional view on the line 7—7 of FIG. 6 showing the grill hanging adjacent the back of the support and the tray supported adjacent the closed sides and also showing the arrangement and relationship of the integral supports on the back and sides.

The stamped integral support shoulders on the sides 6. 7 and back 8 extend inwardly from the sides and back as shown in the drawings to form surface 21, as shown in FIGS. 4, 5 and 7 which extends inwardly of the sides and back and has an integral upwardly projecting surface 22 thereon as shown in the drawings which form integral hooks on the sides 6,7 and the back 8 for engaging with the inverted U shaped edge 26 on the tray T to receive and retain the tray T and the continuous, integral edge 18 on grill G when lifted in position in the support S. The tray T may be provided with suitable heat forming, or heat supplying material, such as by way of example only wood, charcoal, chemicals or any other suitable material. This supplies heat to the adjacent grill G on which is supported food, water and the like for cooking or heating when the tray is positioned on the middle row MR, or bottom row BR of support shoulders.

The tray T includes a surface 25*a* surrounding by an upstanding edge 26 which preferably extends all the way around the tray, but may extend only partially around the tray. The upstanding edge 26 is preferably formed integral with the surface 25*a* of the tray and the edge 26 is configured to generally assume an inverted U shape represented at 50 so that one leg of the U may overlap the upwardly projecting surface 22 of the support shoulder when the tray is inserted in the open support and between the sides 6 and 7 and on the back 8 to retain the tray in position while in use.

Figure 6:
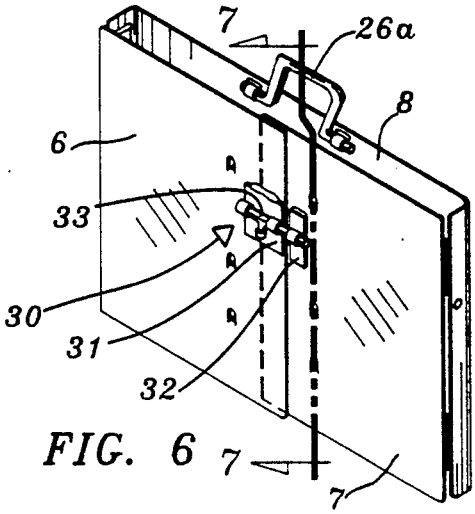
FIG. 6 is a perspective view of the present invention showing the support in collapsed or closed position with the grill and tray supported between the back and the two sides of the support.

A handle 26 is pivotally secured in brackets 28 and 29 on the back 8 and projects upwardly above the upper edge 9 of the back 8 for grasping when it is desired to move the support 8 or when the support 8 is collapsed, or closed as shown in FIG. 6 for transport from one location to another as shown in FIG. 6.

A latch represented generally at 30 is provided to secure the collapsed support S with the tray T and the grill G within the support. The latch may be of any suitable type, and as shown includes members 31, 32 secured in alignment on each side 6 and 7 by any suitable means. A bolt 33 is slidably supported on member 31 in any suitable manner such as shown in FIG. 6, and member 32 is provided with an opening or other suitable means for engaging with the bolt 33 when the bolt is moved from a a non engaged position to the engaged position shown in FIG. 6. The sides 6,7 are of a lateral width to overlap when closed as shown in FIG. 6.

When it is desired to move the support S, or when use of the device is completed and it is desired to transport it, the tray T is disengaged from the shoulder supports with which it is engaged either in the row MR on the sides 6, 7 and from row 24, or removed from the shoulder supports in row 25, depending upon which row with which it was engaged, and then removed from between the first and second sides. The grill is disengaged from the shoulder supports TR and swung or lowered to hang down next to the back as shown in FIG. 1. The tray T is positioned next to the vertically standing grill as shown in FIG. 7, and the sides 6, 7 are swung inwardly toward each other so that the bolt may engage with member 32 to secure the tray T and grill in position between the collapsed or closed sides 6 and 7. The tray T is positioned so that the shoulder support in TR is positioned adjacent the surface 25*a* of the tray so that the edge 26 of the tray is above one of, and preferably the upper most shoulder support on the tray. This prevents the tray from falling out the open lower end of the closed support as seen in FIG. 8. Also, the inside surface of the sides 6 and 7 fictionally engage the tray T when they are latched in closed position to further assist in retaining the tray in the closed support A.

One of the primary advantages of the present invention is that the support, grill and tray of the present invention are particularly designed for mass production to reduce the cost while providing a sturdy, long lasting construction. The support may be quickly and easily opened, the grill and tray positioned for use and then the tray and grill positioned between the back, first and second side portions 11 and 12 and sides 6 and 7 so when they are moved to closed position the complete assembly may be readily manually moved.

A preferred method of forming and assembling the components of the present invention will be described, but it can be understood that the particular sequence of steps set forth herein may be changed as desired.

A method of forming and assembling the portable support S for the tray T to receive and retain heat supplying material and the grill for supporting food and the like for heating, cooking and the like wherein the support may be collapsed when not in use to secure the tray and grill within the support for easy transport preferably includes the following steps, but not necessarily in the same order.

A piece of suitable metal which is well known to those in the sheet metal field may be formed or stamped in a manner well known in the sheet metal industry to provide a flat back for use with the support S, wherein the back includes an upper and bottom edge and an integral first and a second vertical edge end portion integral with and projecting from the flat back support.

The first and second sides for the support may be formed by cutting a pair of metal pieces. The single support shoulders forming each row in the first and second sides are formed by stamping the first and second sides to form three horizontal rows of inwardly extending, vertically spaced and preferably vertically aligned support shoulders in each of the first and second sides. Forming the support shoulders integrally avoids the additional expense of forming them separately and then connecting them to the sides.

The grill surface can be formed of suitable wire mesh, well known to those skilled in the art of the sheet metal industry, and a continuous strip of metal may be welded or otherwise secured around the edge of the surface.

The tray is formed of suitable metal and is stamped to provide a flat surface having an integral inverted U shaped member extending at least partially around the edge of the tray whereby the U shaped edge of the inverted U shaped member may be releasably engaged with the support shoulders on the flat back and first and second sides of the support to position the tray in spaced relation to the grill when the tray and grill are in use.

The grill adjacent its upper end edges is pivotally connected to the first and second vertical edge portions so that the grill extends therebetween and hangs downwardly adjacent the flat back of the support when not in use. The lower edge of the grill is above the bottom edge 10 of the back when it is hanging down adjacent the back as shown in the drawings.

The flat metal back of the support is stamped to form two integral side portions which are laterally spaced and project forwardly from the back, and two pair of inwardly extending, laterally spaced support shoulders, with the support shoulders in each pair being vertically aligned, vertically spaced and horizontally aligned with the two lower of the support shoulders on the first and second sides to form two vertically spaced rows in the back whereby the inverted U shaped members on the tray may be selectively engaged in either row of support shoulders on the back and the first and second sides to releasably position the tray in a selected spaced relation to the grill in the support for use when desired.

The first and second sides of the support are pivotally connected to the back by hinges mounted on the inside of the the first and second integral side portions projecting from the flat back of the support and also connected to the inside of the first and second sides to enable the first and second sides to be pivoted to and stopped in vertical position in relation to the flat back of the support when the support is in use.

The supports for the handle are secured on the inside surface of the the flat back of the support for pivotal movement relative thereto by any means well known to those skilled in working with metal. The handle projects upwardly above the flat back support for easy access when the support is collapsed for transport or for moving the open support during use.

A latch arrangement includes two members welded on each of the support sides for receiving a movable bolt for engaging between the two members for connecting the two sides together when the grill and the tray are hanging in the support between the flat back and closed sides of the support whereby the support, grill and tray may be readily moved or transported. The present invention, when closed prevents grease or other matter from contacting the clothes or body of the person carrying it.

What is claimed is:

1. A portable support for a tray to receive heat supplying material and a grill for supporting food and the like for heating, cooking and the like wherein the support may be collapsed to secure the tray and grill within the support for easy transport when the support is not in use, said support including a back, said back having an upper and a bottom edge, spaced, vertically extending first and second side portions extending forwardly therefrom, a first side and second side pivotally connected, respectively, to said first and second side portions to move to a vertical position relative to said back when the support is open for use and to be closed to a position adjacent said back when the support is to be transported, a grill having a surface surrounded by a continuous, integral edge with projections in said edge which extend through said first and second side portions to pivotally connect said grill to said side portions for hanging to extend downwardly adjacent said back surface when not in use, three rows of vertically spaced, horizontally aligned integral support shoulders in said first and second sides of support shoulders, said support shoulders extending inwardly from said first and second sides, said grill edge engaging with the uppermost row of support shoulders in said sides when the support is open to maintain the grill in vertical position in relation to said back for cooking, a tray for receiving material to supply heat for cooking on the grill when the grill is vertical to said back, said back having two rows of vertically spaced, horizontally aligned integral support shoulders which are aligned with the two lowermost rows in said first and second sides, said tray engagable with either row of said support shoulders below the uppermost row in said sides and with one of said aligned rows in said back to support said tray when the support is open for cooking to maintain the tray in generally parallel position in relation to said grill and spaced therebeneath in vertical position in relation to said back, a handle pivotally mounted on said back adjacent the upper edge thereof for extending there above when the support is in collapsed position for transport, and a bolt latch supported on said two sides for releasably securing said first and second sides when they are folded toward each other to secure the tray and grill in position between the back and closed sides of the support.

2. A method of forming a portable support for a tray to receive heat supplying material and a grill for supporting food and the like for heating, cooking and the like wherein the support may be collapsed when not in use to secure the tray and grill within the support for easy transport, comprising the steps of:

forming a piece of metal to provide a flat back for the support having an upper and bottom edge and an integral first and a second vertical edge portion projecting from the flat back support;

forming a pair of metal pieces to provide first and second sides for the support;

forming a grill with a surface having openings therein which supports food or the like and securing a continuous, integral metal strip around the side, front and back edges of the grill surface;

forming the tray to provide a flat surface having an inverted U-shaped member extending at least partially around the edge of the tray for releasably engaging the inverted U shaped member with the flat back and first and second sides of the support to position the tray in spaced relation beneath the grill when the tray and grill are in use;

pivotally connecting the grill adjacent its upper side and edges to the first and second vertical edge portions so that the grill extends therebetween and hangs downwardly adjacent the flat back of the support when not in use;

stamping the first and second sides to form three rows of inwardly extending and vertically aligned support shoulders in each of the first and second sides, the aligned support shoulders in the uppermost row being provided for engaging with the grill when it is pivoted up from its hung position on the first and second edge portions;

stamping the flat back of the support to form two pairs of inwardly extending, laterally spaced support shoulders, with the support shoulders in each pair being vertically aligned, vertically spaced and horizontally aligned with two of the support shoulders on the sides to form two vertically spaced rows whereby the inverted U shaped members on the tray may be selectively engaged in either row of aligned support shoulders on the sides and back to releasably position the tray in the support beneath the grill for use when desired;

pivotally connecting the first and second sides of the support respectively with the first and second edge portions projecting from the flat back of the support to enable the sides to be pivoted to vertical position in relation to the flat back of the support when the support is in use;

securing a handle to the flat back of the support for pivotal movement relative thereto, said handle projecting upwardly above the flat back support for easy access when the support is collapsed for transport; and securing a latch arrangement on the two sides for connecting the two sides together when the grill and the tray are hanging in the support between the flat back and closed sides of the support whereby the support, grill and tray may be readily transported.

* * * * *